US011191363B2

(12) United States Patent
Gleason et al.

(10) Patent No.: US 11,191,363 B2
(45) Date of Patent: Dec. 7, 2021

(54) DUAL-USE SUPPORT CUSHION

(71) Applicant: London Luxury LLC, New Rochelle, NY (US)

(72) Inventors: Danielle Gleason, New Rochelle, NY (US); Steve Schwartz, New Rochelle, NY (US); May Chan, New Rochelle, NY (US)

(73) Assignee: LONDON LUXURY LLC, New Rochelle, NY (US)

( * ) Notice: Subject to any disclaimer, the term of this patent is extended or adjusted under 35 U.S.C. 154(b) by 0 days.

(21) Appl. No.: 16/815,631

(22) Filed: Mar. 11, 2020

(65) Prior Publication Data

US 2021/0282557 A1 Sep. 16, 2021

(51) Int. Cl.
*A47C 7/02* (2006.01)

(52) U.S. Cl.
CPC ..... *A47C 7/021* (2013.01)

(58) Field of Classification Search
CPC .. A47C 7/021; A47C 7/40; A47C 7/42; A47C 7/386; A47C 7/425; A47G 9/1081; A47G 9/1036; A47G 9/0253
See application file for complete search history.

(56) References Cited

U.S. PATENT DOCUMENTS

| | | | | |
|---|---|---|---|---|
| 5,390,384 | A * | 2/1995 | Dinsmoor, III | A61G 5/1045 5/654 |
| 6,241,320 | B1 * | 6/2001 | Chew | A47C 7/021 297/452.26 |
| 9,233,630 | B2 * | 1/2016 | Amirault | B60N 2/2866 |
| 2005/0235423 | A1 * | 10/2005 | Hetzel | A61G 5/1043 5/653 |
| 2007/0096519 | A1 * | 5/2007 | Conforti | A47C 31/126 297/218.2 |
| 2015/0082545 | A1 * | 3/2015 | Holbrook | A47G 9/0215 5/636 |
| 2017/0000264 | A1 * | 1/2017 | Krishtul | A47C 7/18 |
| 2017/0347803 | A1 * | 12/2017 | Krishtul | A47C 7/46 |
| 2020/0245737 | A1 * | 8/2020 | Ali | A47C 7/62 |

* cited by examiner

*Primary Examiner* — Robert G Santos
*Assistant Examiner* — Alison N Labarge
(74) *Attorney, Agent, or Firm* — Cozen O'Connor

(57) ABSTRACT

A dual-use support cushion includes a seat cushion side and a back cushion side, with the seat cushion side configured to provide seat support and the back cushion side configured to provide back support. The dual-use pillow is an all-in-one design that allows the owner to choose between using the dual-use support cushion as back support or as a seat support and the owner can manually flip the cushion depending on what side is more appropriate for the user at any given moment. The dual-use support cushion provides, in a single item, the option of sitting on the cushion, and the option for using the same cushion, after relocation of the cushion, for back support.

5 Claims, 5 Drawing Sheets

DUAL-USE SUPPORT CUSHION

BACKGROUND OF THE INVENTION

1. Field of the Invention

The present invention is directed to a dual-use padded cushion that provides the option for use as either a seat cushion or a back support cushion.

2. Description of the Related Art

Padded seat cushions come in multiple different varieties, but generally consist of a padded cushion covered by a fabric or other cloth-like material, the cushion being in the shape and size to be placed on top of a surface generally used to sit on, such as a seating surface of a chair. One side of the seat cushion is generally designed for comfort and for contact with the buttocks of the user, while the opposite side is designed for contacting the upper surface of the chair and typically has some type of gripping material or strapping mechanism so the cushion will stay stationary while seated.

Padded back cushions come in multiple different varieties, but generally consist of a padded cushion covered by a fabric or other cloth-like material, the cushion being in the shape and size to provide support to and cover the width of the user's back while the user is in the seated position. One side of the back cushion is generally designed for comfort while contacting the user's back and to provide support between the user's back and the upright seat surface, such as the back of a chair. The opposite side is placed in contact with the upright seat surface and typically has some type of gripping material or strapping mechanism so the cushion will stay stationary while the user is seated.

It has long been recognized that there have been numerous variations of seats, cushions, chairs, pads, etc. that have been designed to provide additional support to users of the cushion.

It has also long been recognized that there have been various designs and iterations of back supports, cushions, pillows, braces, etc. to provide support for aching backs, namely, additional lumbar support.

Combinations of back and seat cushions also exist but either in the form of two separately sold items or as an elongated cushion that extends from the back support all the way down to a seat support as one long cushion.

Previous attempts to address providing additional seat and back support have not recognized the importance or potential need of having a dual-use product that gives users the option with only one product to solve either issue and allowing the user to choose between seat support or back support depending on which is required at that moment.

The conventional method of padded cushions for seat support and back support creates drawbacks including, but not limited to, the requirement that a person has to own and use multiple different products to obtain the desired support on different occasions, which also leads to increased storage and a greater likelihood one would misplace one of the desired cushions when it was needed.

Thus, there is a need for a dual-use support cushion that allows the user the option of either back support or seat support at different times without creating the undue burden of additional equipment.

SUMMARY OF THE INVENTION

In accordance with an aspect of the invention, a dual-use padded cushion is disclosed which has the ability to support a user in a seated position and alleviate discomfort and pain as either a seat cushion or back cushion depending on which type of cushion is desired at any given moment. Contrary to the prior art in which seat and back cushions are arranged as separate items, or as one elongated version that requires the use of both the seat and back cushion at the same exact time, the present invention allows for individuals to select between a seat support and back support using the very same product, but not requiring use of both at the same time. The dual-use is created through creative design of a cushion having two distinct sides, with one side providing seat support for use when a seat support is desired, and the other side providing back support for use when a back support is desired. The user can manually flip the cushion over from top to bottom and arrange the cushion appropriately in relation to the seat to choose what type of support they desire.

The dual-use configuration provides for improved efficiency and provides users with additional options for providing comfort and support. Rather than someone having to own two separate seat and back cushions, or a single, very large cushion that is connected that provides both functions, the dual-use support cushion according to an aspect of the present invention is an all-in-one article that selectively provides both seat and back support without requiring additional products or difficult storage.

The current design theory in the prior art for seat and back cushions is to build the cushions completely separate from one another or in one long, continuous pillow that requires both to be used at the same time. Though this concept does work to a certain degree, the invention disclosed herein teaches away from the idea of requiring multiple or inconvenient products but rather teaches to an easy-to-use and all-in-one device that allows individuals the choice with a single dual-use support cushion between either a seat support or a back support.

In accordance with an aspect of the present invention, a dual-use support cushion for use with a seat includes: a seat cushion side that, when the dual-use support cushion is positioned with respect to the seat in a first position, with the seat cushion side facing upwards, serves as a seat support supporting and cushioning the legs and buttocks of user; and a back cushion side that, when the dual-use support cushion is positioned with respect to the seat in a second position, with the back cushion side facing outwards, serves as a back support supporting and cushioning the back of the user. The dual-use support cushion is structured so as to be manually switchable between the first and second positions.

In another aspect, the dual-use support cushion further includes: a memory foam cushion, arranged in a core of the dual-use support cushion, for padded support for the dual-use support cushion; and a zippered removable cover made of a material comfortable to human touch surrounding the memory foam cushion in its entirety.

In another aspect, the dual-use support cushion further includes, only on the seat cushion side: a pressure relief coccyx cut out; and a contour adding additional user comfort when placed in the first position and assisting the user to acquire proper form and posture in the seated position.

In another aspect, the dual-use support cushion further includes, only on the back cushion side: a cooling comfort gel material positioned and oriented, when the dual-use support cushion is in the second position, vertically and centrally on the back cushion side so as to contact the user's back.

In another aspect, when the dual-use support cushion is in the first position, the cooling comfort gel material contacts the seat so as to provide traction between the seat and the dual-use support cushion.

In another aspect, the zippered removable cover has a zipper that begins at a first midpoint on a lateral edge of the dual-use cushion, and is configured to travel 180 degrees to a second midpoint on the lateral edge of the dual-use support cushion.

In another aspect, the pressure relief coccyx cut out begins on a back edge of the seat cushion side and has a substantially semicircular shaped concavity to provide coccyx and tailbone relief when the dual-use support cushion is in the first position.

Examples of dual-use padded cushions in accordance with aspects of the present invention are illustrated in the accompanying figures.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1A:
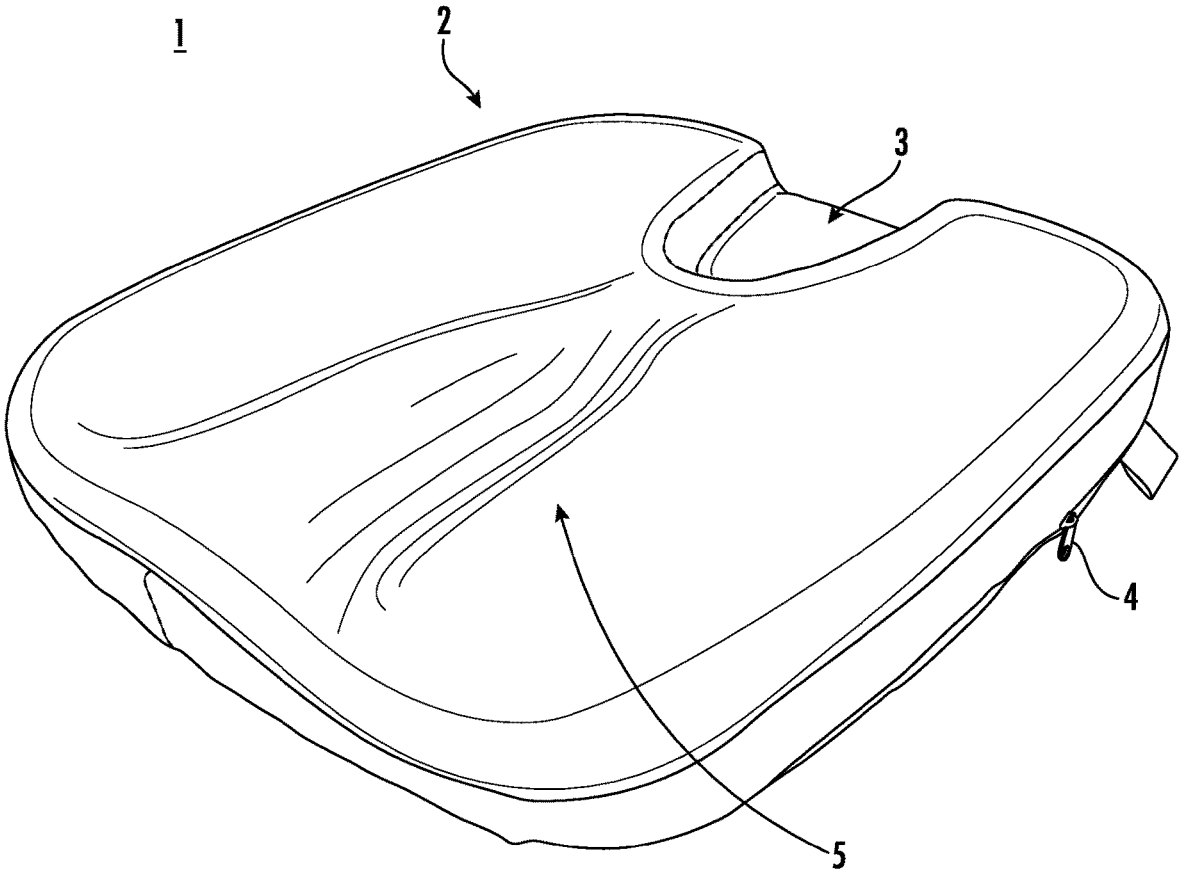
FIG. 1A is a perspective view of a seat cushion side of the dual-use support cushion configured as a seat support.

FIG. 1A is a perspective view of a seat cushion side 2 of a dual-use support cushion 1 facing upwards in accordance with an embodiment of the present invention. The dual-use support cushion 1 is shown in FIG. 1A to illustrate the seat cushion side 2 positioned facing upwards for its intended use.

Figure 3A:
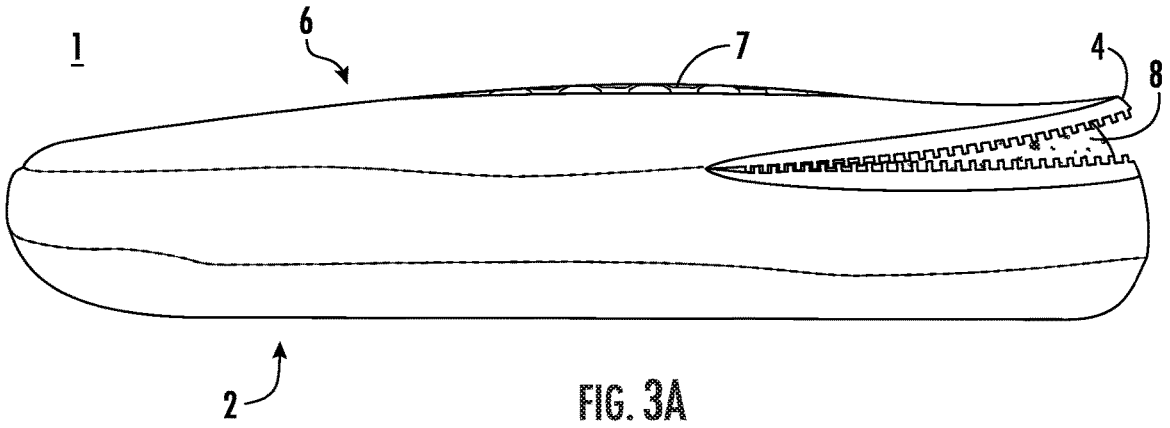
FIG. 3A is a side view of the dual-use support cushion with the back cushion side facing up and the zippered removable cover slightly open showing the memory foam cushion material.
Figure 3B:
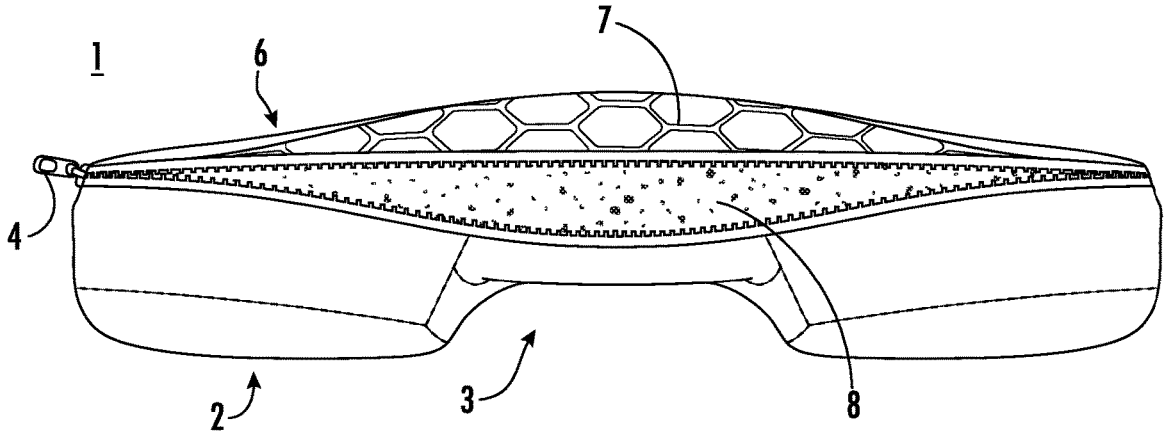
FIG. 3B is a side view of the dual-use support cushion and pressure relief coccyx cut out with the back cushion side and cooling comfort gel facing up and the zippered removable cover slightly open showing the memory foam cushion material that is arranged and forms the core of the dual-use support cushion.

The seat cushion side 2 of the dual-use support cushion 1 in FIG. 1A shows a zippered removable cover 4 in a closed position starting in the middle on the side of the dual-use support cushion 1 and centered between the seat cushion side 2 and a back cushion side 6 to be discussed further below. The zippered removable cover 4 surrounds the entirety of the memory foam cushion 8, which is shown in FIGS. 3A and 3B. The zippered removable cover 4 that forms the exterior of the dual-use support cushion 1 is made of a material that is comfortable to the touch.

The seat cushion side 2 has a pressure relief coccyx cut out 3 in a generally semicircular shape on the back edge side of the dual-use support cushion 1, and only on the seat cushion side 2. The pressure relief coccyx cut out 3 has a substantially semicircular shaped concavity to provide coccyx and tailbone relief.

The memory foam cushion 8 material that is arranged and forms the core of the dual-use support cushion 1 also provides the seat cushion side 2 with ergonomically designed contours 5 down the middle, beginning at the pressure relief coccyx cut out 3 and leading to the front edge of the seat cushion side 2 for assistance with proper posture, alignment, and to help alleviate pain and discomfort. The contour 5 assists the user in the seated position to achieve proper posture and additional comfort by placing one leg and buttock on each side of the contour 5.

Figure 1B:
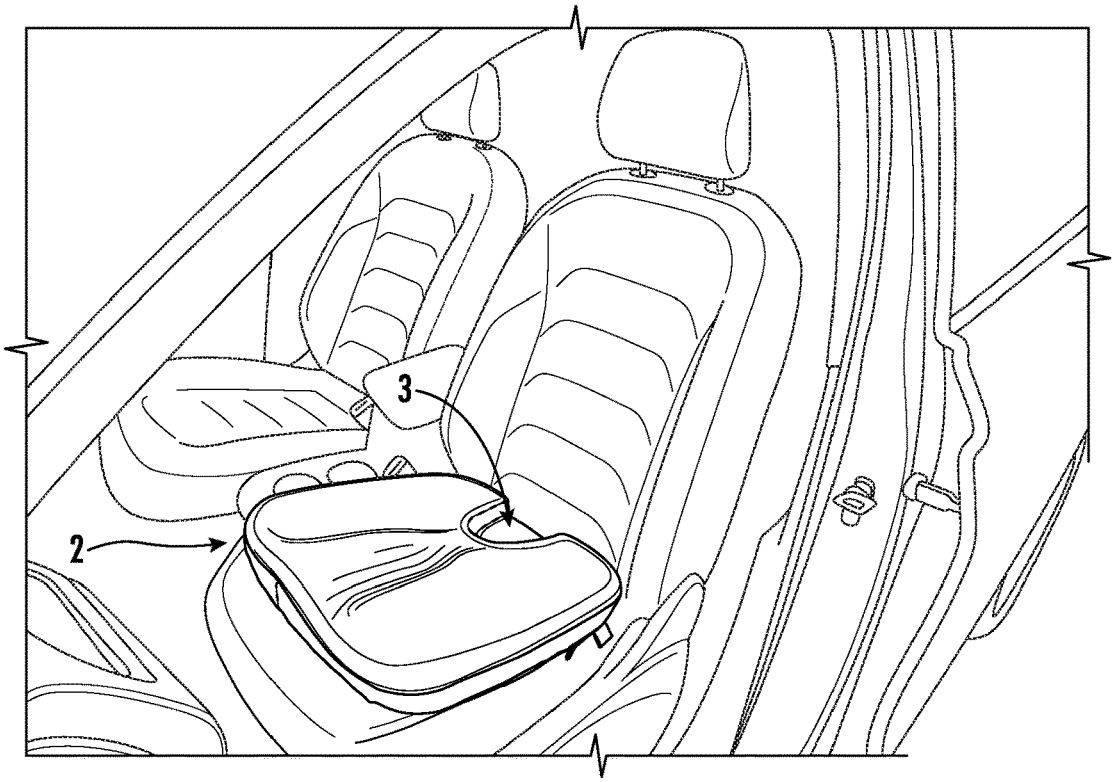
FIG. 1B is a perspective view of the seat cushion side of the dual-use support cushion configured as a seat support and positioned ready for use in a car.

FIG. 1B illustrates the dual-use support cushion 1 with the seat cushion side 2 facing upwards in its intended position to provide seat support to the user. The dual-use support cushion 1 is placed in use in a car seat to illustrate the positioning of the seat cushion side 2 in its intended position to provide seat support.

In FIG. 1B, the cooling comfort gel 7 on the back cushion side 6 is positioned facing downwards in contact with the seat surface to provide additional traction. The pressure relief coccyx cut out 3 is located at the back edge of the dual-use support cushion 1 only on the seat cushion side 2 and is positioned adjacent to the upright portion of the car seat.

Figure 1C:
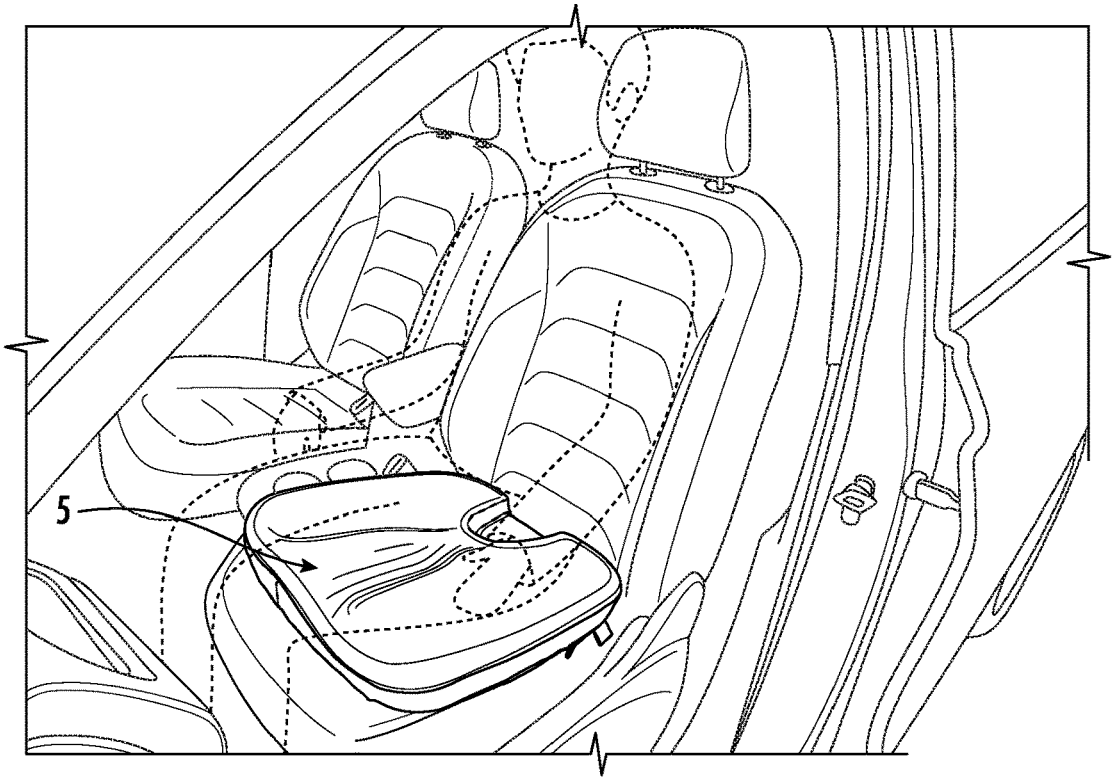
FIG. 1C is a perspective view of the seat cushion side of the dual-use support cushion configured as a seat support and positioned ready for use in a car with the dotted outline of a user to illustrate the intended use.

FIG. 1C illustrates the same dual-use support cushion 1 and seat cushion side 2 positioning as in FIG. 1B but also includes a dotted line to illustrate the intended use by a car passenger, whose outline is shown by the dotted line. FIG. 1C shows the dual-use support cushion 1 with the seat cushion side 2 in an upward facing position with the back cushion side 6 and cooling comfort gel 7 in contact with the seating portion of the car seat. The seat cushion side 2 and contour 5 is positioned such that, when the user is in a seated position, the user will place his/her buttocks and upper legs on each side of the contour 5 with his/her tailbone positioned resting above the pressure relief coccyx cut out 3.

Figure 2A:
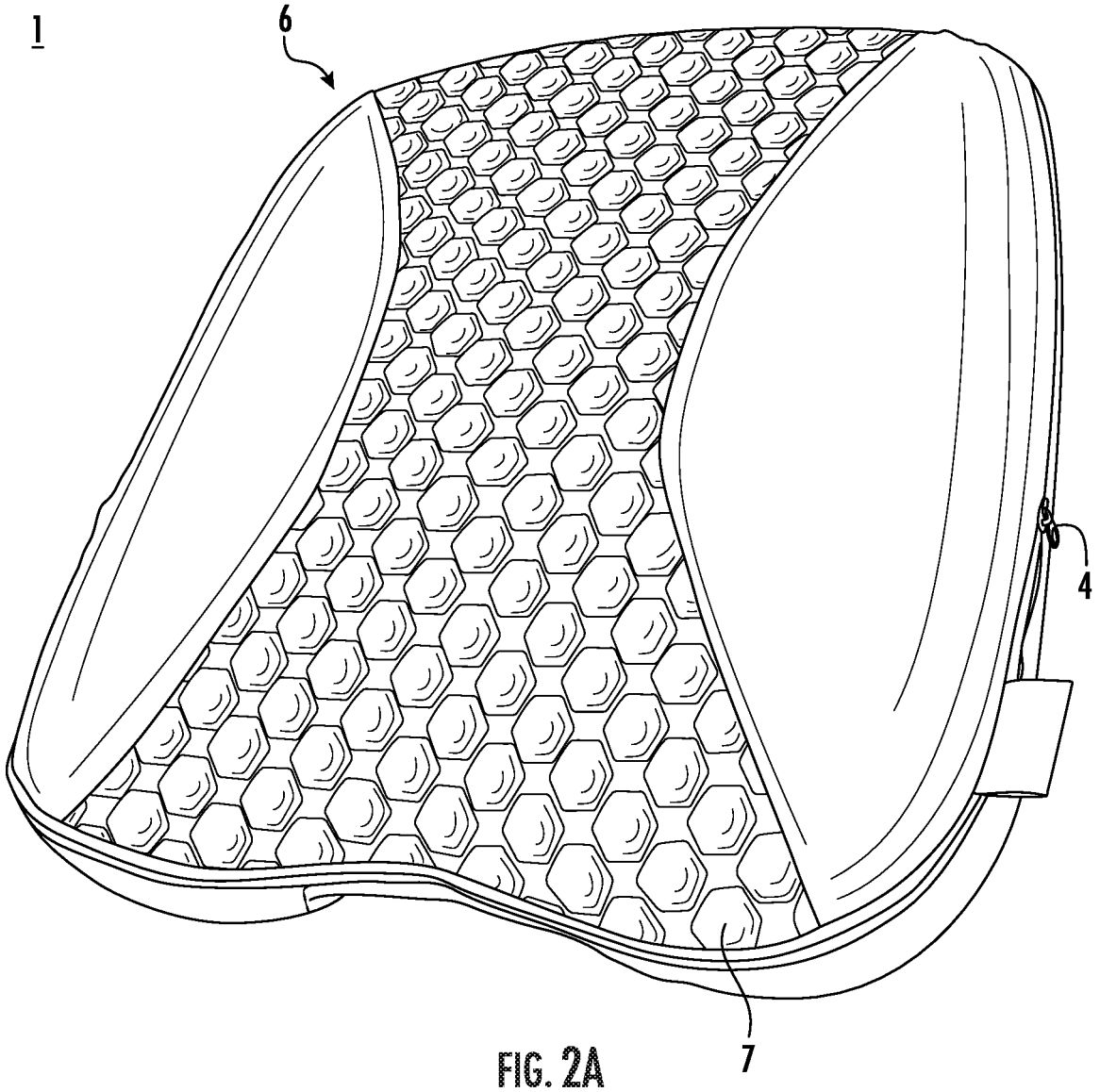
FIG. 2A is a perspective view of a back cushion side of the dual-use support cushion configured as a back support.

FIG. 2A is a perspective view of the back cushion side 6 of the dual-use support cushion 1 showing the side of the dual-use support cushion 1 opposite the seat cushion side 2 that was shown in FIG. 1A in accordance with an embodiment of the present invention. FIG. 2A illustrates the back cushion side 6 facing outwards and oriented vertically in its normal, intended position for use as a back cushion.

FIG. 2A illustrates the back cushion side 6 that utilizes the same memory foam cushion 8 enclosed by the zippered removable cover 4 in a closed position that surrounds the entirety of the memory foam cushion 8, as described above in relation to the seat cushion side 2. A portion of the zippered removable cover 4 on the back cushion side 6 only is made of cells filled with a cooling comfort gel 7 material, to provide temperature control and added support for the user's back.

The cooling comfort gel 7 also provides traction when in contact with the seating surface when the dual-use support cushion 1 is being used for seat support, in which case the back cushion side 6 would be facing downwards. The cooling comfort gel 7 is positioned vertically on the back cushion side 6 down the middle and starting at its largest width in each corner of the back cushion side 6, becoming more narrow towards the center of the back cushion side 6, and then extending back to its original width at the opposite corners on the same back cushion side 6.

Figure 2B:
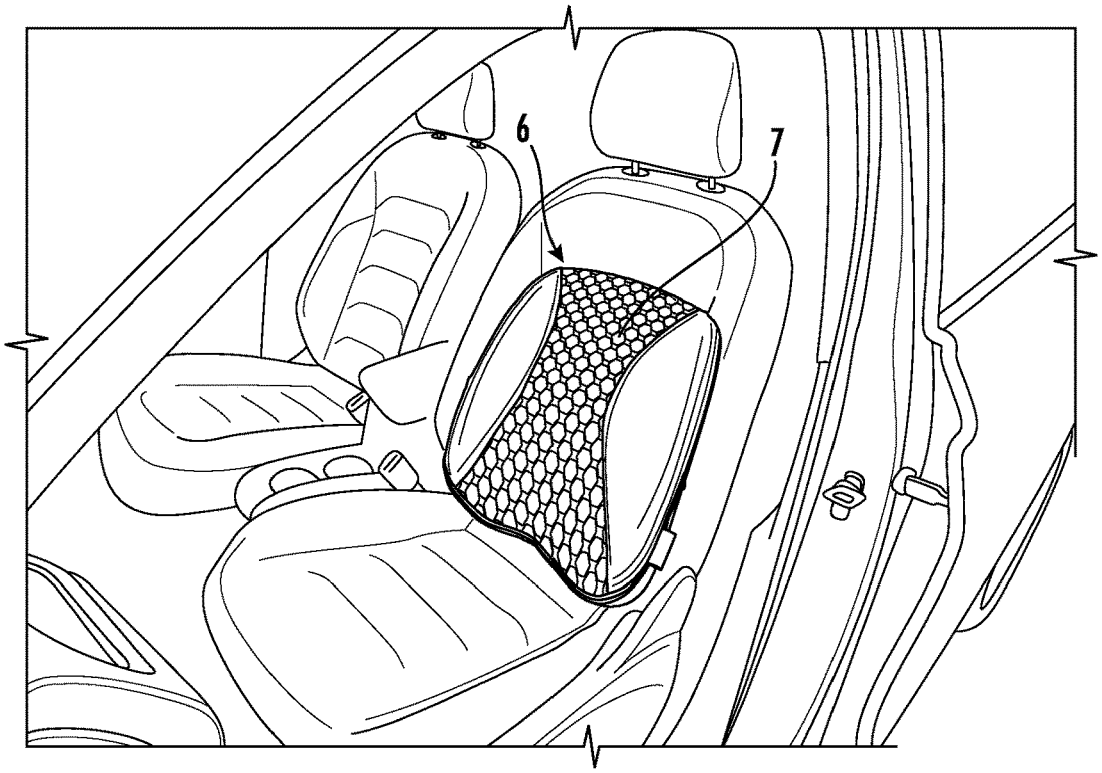
FIG. 2B is a perspective view of the back cushion side of the dual-use support cushion configured as a back support and positioned ready for use in a car.

FIG. 2B illustrates the dual-use support cushion 1 with the back cushion side 6 facing outwards in its intended position to provide back support to the user. The dual-use support cushion 1 is placed in use in a car seat to illustrate the positioning of the back cushion side 6. The cooling comfort gel 7 is positioned down the center of the back cushion side and facing outward.

Figure 2C:
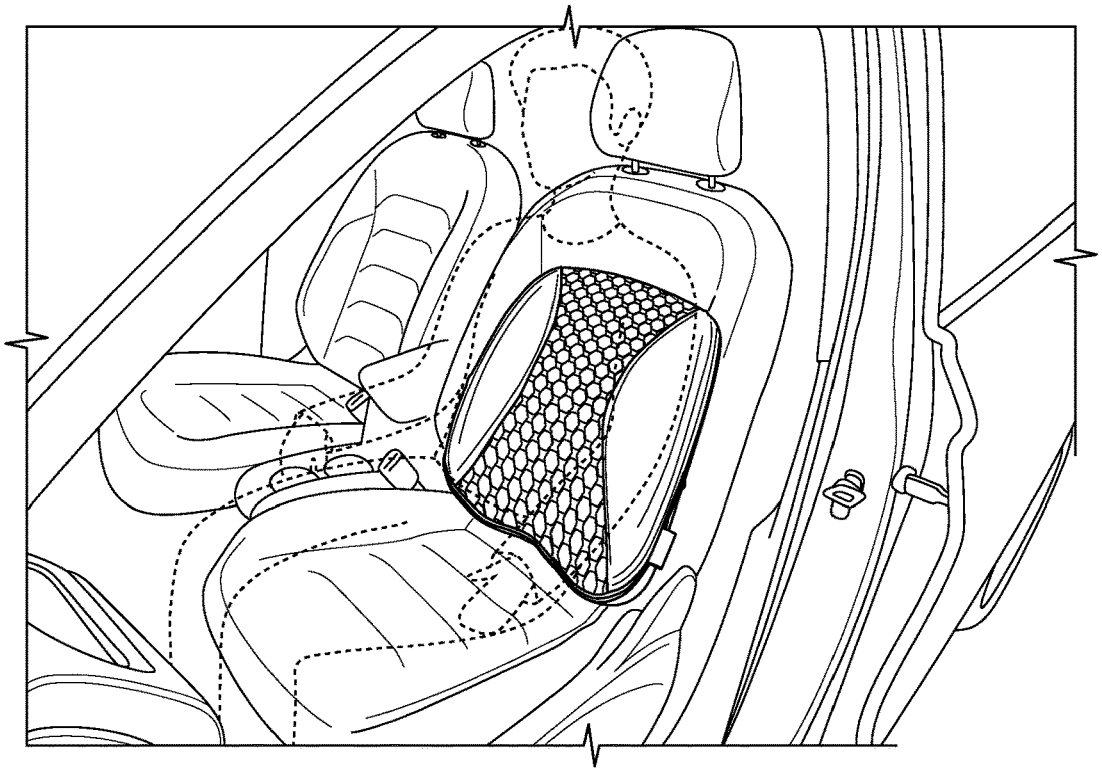
FIG. 2C is a perspective view of the back cushion side of the dual-use support cushion configured as a back support and positioned ready for use in a car with the dotted outline of a user to illustrate the intended use.

FIG. 2C illustrates the same dual-use support cushion 1 and back cushion side 6 positioning as in FIG. 2B but also includes a dotted line to illustrate the intended use by a car passenger, whose outline is shown by the dotted line. FIG. 2C shows the dual-use support cushion 1 with the back cushion side 6 in an outward facing position with the seat cushion side 2 in contact with the upright portion of the car seat. The back cushion side 6 and cooling comfort gel 7 is positioned such that each comes in contact with the individual's back when in a seated position to provide lumbar support, assist with posture, alleviate back pain, and provide cooling.

FIG. 3A shows a side view of the dual-use support cushion 1 with the seat cushion side 2 facing down and the back cushion side 6 facing up with a slight view of the cooling comfort gel 7 on the back cushion side 6. FIG. 3A is used to show the dual-use support cushion 1 with the zippered removable cover 4 in an opened position. With the zippered removable cover 4 slightly open, the memory foam cushion 8 is visible.

FIG. 3B is the back edge side view of the dual-use support cushion 1 with the seat cushion side 2 facing down and the back cushion side 6 facing up with a view of the cooling comfort gel 7 on the back cushion side 6. FIG. 3B shows the side view of the pressure relief coccyx cut out 3 when the seat cushion side 2 is facing downwards. The zippered removable cover 4 is in an open position with a larger view on the memory foam cushion 8.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A dual-use support cushion for use with a seat, comprising:

a seat cushion side configured to, when the dual-use support cushion is positioned with respect to the seat in a first position, with the seat cushion side facing upwards, serve as a seat support supporting and cushioning the legs and buttocks of user;

a back cushion side configured to, when the dual-use support cushion is positioned with respect to the seat in a second position, with the back cushion side facing outwards, serve as a back support supporting and cushioning the back of the user, only on the seat cushion side:

a pressure relief coccyx cut out; and a contour adding additional user comfort when placed in the first position and assisting the user to acquire proper form and posture in the seated position; and only on the back cushion side:

a cooling comfort gel material positioned and oriented, when the dual-use support cushion is in the second position, vertically and centrally on the back cushion side so as to contact the user's back, the cooling gel material being positioned vertically on the back cushion side and arranged so as to have its maximum width in each corner of the back cushion side, becoming more narrow towards the center of the back cushion side, and then extending back to its maximum width at opposite corners on the same back cushion side, wherein the dual-use support cushion is configured to be manually switchable between the first and second positions.

2. The dual-use support cushion according to claim 1, further comprising:

a memory foam cushion, arranged in a core of the dual-use support cushion, for padded support for the dual-use support cushion; and a zippered removable cover made of a material comfortable to human touch surrounding the memory foam cushion in its entirety.

3. The dual-use support cushion according to claim 2, wherein the zippered removable cover has a zipper that begins at a first midpoint on a lateral edge of the dual-use cushion, and is configured to travel 180 degrees to a second midpoint on the lateral edge of the dual-use support cushion.

4. The dual-use support cushion according to claim 1, wherein when the dual-use support cushion is in the first position, the cooling comfort gel material contacts the seat so as to provide traction between the seat and the dual-use support cushion.

5. The dual-use support cushion according to claim 1, wherein the pressure relief coccyx cut out begins on a back edge of the seat cushion side and has a substantially semicircular shaped concavity to provide coccyx and tailbone relief when the dual-use support cushion is in the first position.

* * * * *